US008143620B1

(12) United States Patent
Malinowski et al.

(10) Patent No.: US 8,143,620 B1
(45) Date of Patent: Mar. 27, 2012

(54) SYSTEM AND METHOD FOR ADAPTIVE CLASSIFICATION OF AUDIO SOURCES

(75) Inventors: Stephen Malinowski, Mountain View, CA (US); Carlos Avendano, Mountain View, CA (US)

(73) Assignee: Audience, Inc., Mountain View, CA (US)

( * ) Notice: Subject to any disclaimer, the term of this patent is extended or adjusted under 35 U.S.C. 154(b) by 1083 days.

(21) Appl. No.: 12/004,897

(22) Filed: Dec. 21, 2007

(51) Int. Cl.
*H04R 29/00* (2006.01)

(52) U.S. Cl. ..... 257/56; 257/57; 257/92; 257/98; 257/73.1; 257/94.1; 257/94.2; 257/94.3

(58) Field of Classification Search ..... 381/94.3, 381/94.2, 94.1, 92, 98, 73.1, 57, 56
See application file for complete search history.

(56) References Cited

U.S. PATENT DOCUMENTS

| | | | |
|---|---|---|---|
| 3,976,863 | A | 8/1976 | Engel |
| 3,978,287 | A | 8/1976 | Fletcher et al. |
| 4,137,510 | A | 1/1979 | Iwahara |
| 4,433,604 | A | 2/1984 | Ott |
| 4,516,259 | A | 5/1985 | Yato et al. |
| 4,536,844 | A | 8/1985 | Lyon |
| 4,581,758 | A | 4/1986 | Coker et al. |
| 4,628,529 | A | 12/1986 | Borth et al. |
| 4,630,304 | A | 12/1986 | Borth et al. |
| 4,649,505 | A | 3/1987 | Zinser, Jr. et al. |
| 4,658,426 | A | 4/1987 | Chabries et al. |
| 4,674,125 | A | 6/1987 | Carlson et al. |
| 4,718,104 | A | 1/1988 | Anderson |
| 4,811,404 | A | 3/1989 | Vilmur et al. |
| 4,812,996 | A | 3/1989 | Stubbs |
| 4,864,620 | A | 9/1989 | Bialick |
| 4,920,508 | A | 4/1990 | Yassaie et al. |
| 5,027,410 | A | 6/1991 | Williamson et al. |
| 5,054,085 | A | 10/1991 | Meisel et al. |
| 5,058,419 | A | 10/1991 | Nordstrom et al. |
| 5,099,738 | A | 3/1992 | Hotz |

(Continued)

FOREIGN PATENT DOCUMENTS

| | | |
|---|---|---|
| JP | 62110349 | 5/1987 |

(Continued)

OTHER PUBLICATIONS

Elo, Gary W., "Differential Microphone Arrays," Audio Signal Processing for Next-Generation Multimedia Communication Systems, 2004, pp. 12-65, Kluwer Academic Publishers, Norwell, Massachusetts, USA.

(Continued)

*Primary Examiner* — Tan N Tran
(74) *Attorney, Agent, or Firm* — Carr & Ferrell LLP

(57) ABSTRACT

Systems and methods for adaptively classifying audio sources are provided. In exemplary embodiments, at least one acoustic signal is received. One or more acoustic features based on the at least one acoustic signal are derived. A global summary of acoustic features based, at least in part, on the derived one or more acoustic features is determined. Further, an instantaneous global classification based on a global running estimate and the global summary of acoustic features is determined. The global running estimates may be updated and an instantaneous local classification based, at least in part, on the one or more acoustic features may be derived. One or more spectral energy classifications based, at least in part, on the instantaneous local classification and the one or more acoustic features may be determined. In some embodiments, the spectral energy classification is provided to a noise suppression system.

14 Claims, 7 Drawing Sheets

U.S. PATENT DOCUMENTS

| | | | |
|---|---|---|---|
| 5,119,711 | A | 6/1992 | Bell et al. |
| 5,142,961 | A | 9/1992 | Paroutaud |
| 5,150,413 | A | 9/1992 | Nakatani et al. |
| 5,175,769 | A | 12/1992 | Hejna, Jr. et al. |
| 5,187,776 | A | 2/1993 | Yanker |
| 5,208,864 | A | 5/1993 | Kaneda |
| 5,210,366 | A | 5/1993 | Sykes, Jr. |
| 5,230,022 | A | 7/1993 | Sakata |
| 5,319,736 | A | 6/1994 | Hunt |
| 5,323,459 | A | 6/1994 | Hirano |
| 5,341,432 | A | 8/1994 | Suzuki et al. |
| 5,381,473 | A | 1/1995 | Andrea et al. |
| 5,381,512 | A | 1/1995 | Holton et al. |
| 5,400,409 | A | 3/1995 | Linhard |
| 5,402,493 | A | 3/1995 | Goldstein |
| 5,402,496 | A | 3/1995 | Soli et al. |
| 5,471,195 | A | 11/1995 | Rickman |
| 5,473,702 | A | 12/1995 | Yoshida et al. |
| 5,473,759 | A | 12/1995 | Slaney et al. |
| 5,479,564 | A | 12/1995 | Vogten et al. |
| 5,502,663 | A | 3/1996 | Lyon |
| 5,536,844 | A | 7/1996 | Wijesekera |
| 5,544,250 | A | 8/1996 | Urbanski |
| 5,574,824 | A | 11/1996 | Slyh et al. |
| 5,583,784 | A | 12/1996 | Kapust et al. |
| 5,587,998 | A | 12/1996 | Velardo, Jr. et al. |
| 5,590,241 | A | 12/1996 | Park et al. |
| 5,602,962 | A | 2/1997 | Kellermann |
| 5,675,778 | A | 10/1997 | Jones |
| 5,682,463 | A | 10/1997 | Allen et al. |
| 5,694,474 | A | 12/1997 | Ngo et al. |
| 5,706,395 | A | 1/1998 | Arslan et al. |
| 5,717,829 | A | 2/1998 | Takagi |
| 5,729,612 | A | 3/1998 | Abel et al. |
| 5,732,189 | A | 3/1998 | Johnston et al. |
| 5,749,064 | A | 5/1998 | Pawate et al. |
| 5,757,937 | A | 5/1998 | Itoh et al. |
| 5,792,971 | A | 8/1998 | Timis et al. |
| 5,796,819 | A | 8/1998 | Romesburg |
| 5,806,025 | A | 9/1998 | Vis et al. |
| 5,809,463 | A | 9/1998 | Gupta et al. |
| 5,825,320 | A | 10/1998 | Miyamori et al. |
| 5,839,101 | A | 11/1998 | Vahatalo et al. |
| 5,920,840 | A | 7/1999 | Satyamurti et al. |
| 5,933,495 | A | 8/1999 | Oh |
| 5,943,429 | A | 8/1999 | Handel |
| 5,956,674 | A | 9/1999 | Smyth et al. |
| 5,974,380 | A | 10/1999 | Smyth et al. |
| 5,978,824 | A | 11/1999 | Ikeda |
| 5,983,139 | A | 11/1999 | Zierhofer |
| 5,990,405 | A | 11/1999 | Auten et al. |
| 6,002,776 | A | 12/1999 | Bhadkamkar et al. |
| 6,061,456 | A | 5/2000 | Andrea et al. |
| 6,072,881 | A | 6/2000 | Linder |
| 6,097,820 | A | 8/2000 | Turner |
| 6,108,626 | A | 8/2000 | Cellario et al. |
| 6,122,610 | A | 9/2000 | Isabelle |
| 6,134,524 | A | 10/2000 | Peters et al. |
| 6,137,349 | A | 10/2000 | Menkhoff et al. |
| 6,140,809 | A | 10/2000 | Doi |
| 6,173,255 | B1 | 1/2001 | Wilson et al. |
| 6,180,273 | B1 | 1/2001 | Okamoto |
| 6,216,103 | B1 | 4/2001 | Wu et al. |
| 6,222,927 | B1 | 4/2001 | Feng et al. |
| 6,223,090 | B1 | 4/2001 | Brungart |
| 6,226,616 | B1 | 5/2001 | You et al. |
| 6,263,307 | B1 | 7/2001 | Arslan et al. |
| 6,266,633 | B1 | 7/2001 | Higgins et al. |
| 6,317,501 | B1 | 11/2001 | Matsuo |
| 6,339,758 | B1 | 1/2002 | Kanazawa et al. |
| 6,355,869 | B1 | 3/2002 | Mitton |
| 6,363,345 | B1 | 3/2002 | Marash et al. |
| 6,381,570 | B2 | 4/2002 | Li et al. |
| 6,430,295 | B1 | 8/2002 | Handel et al. |
| 6,434,417 | B1 | 8/2002 | Lovett |
| 6,449,586 | B1 | 9/2002 | Hoshuyama |
| 6,469,732 | B1 | 10/2002 | Chang et al. |
| 6,487,257 | B1 | 11/2002 | Gustafsson et al. |
| 6,496,795 | B1 | 12/2002 | Malvar |
| 6,513,004 | B1 | 1/2003 | Rigazio et al. |
| 6,516,066 | B2 | 2/2003 | Hayashi |
| 6,529,606 | B1 | 3/2003 | Jackson, Jr. II et al. |
| 6,549,630 | B1 | 4/2003 | Bobisuthi |
| 6,584,203 | B2 | 6/2003 | Elko et al. |
| 6,622,030 | B1 | 9/2003 | Romesburg et al. |
| 6,717,991 | B1 | 4/2004 | Gustafsson et al. |
| 6,718,309 | B1 | 4/2004 | Selly |
| 6,738,482 | B1 | 5/2004 | Jaber |
| 6,760,450 | B2 | 7/2004 | Matsuo |
| 6,785,381 | B2 | 8/2004 | Gartner et al. |
| 6,792,118 | B2 | 9/2004 | Watts |
| 6,795,558 | B2 | 9/2004 | Matsuo |
| 6,798,886 | B1 | 9/2004 | Smith et al. |
| 6,810,273 | B1 | 10/2004 | Mattila et al. |
| 6,882,736 | B2 | 4/2005 | Dickel et al. |
| 6,915,264 | B2 | 7/2005 | Baumgarte |
| 6,917,688 | B2 | 7/2005 | Yu et al. |
| 6,944,510 | B1 | 9/2005 | Ballesty et al. |
| 6,978,159 | B2 | 12/2005 | Feng et al. |
| 6,982,377 | B2 | 1/2006 | Sakurai et al. |
| 6,999,582 | B1 | 2/2006 | Popovic et al. |
| 7,016,507 | B1 | 3/2006 | Brennan |
| 7,020,605 | B2 | 3/2006 | Gao |
| 7,031,478 | B2 | 4/2006 | Belt et al. |
| 7,054,452 | B2 | 5/2006 | Ukita |
| 7,065,485 | B1 | 6/2006 | Chong-White et al. |
| 7,076,315 | B1 | 7/2006 | Watts |
| 7,092,529 | B2 | 8/2006 | Yu et al. |
| 7,092,882 | B2 | 8/2006 | Arrowood et al. |
| 7,099,821 | B2 | 8/2006 | Visser et al. |
| 7,142,677 | B2 | 11/2006 | Gonopolskiy |
| 7,146,316 | B2 | 12/2006 | Alves |
| 7,155,019 | B2 | 12/2006 | Hou |
| 7,164,620 | B2 | 1/2007 | Hoshuyama |
| 7,171,008 | B2 | 1/2007 | Elko |
| 7,171,246 | B2 | 1/2007 | Mattila et al. |
| 7,174,022 | B1 | 2/2007 | Zhang et al. |
| 7,206,418 | B2 | 4/2007 | Yang et al. |
| 7,209,567 | B1 | 4/2007 | Kozel et al. |
| 7,225,001 | B1 | 5/2007 | Eriksson et al. |
| 7,242,762 | B2 | 7/2007 | He et al. |
| 7,246,058 | B2 | 7/2007 | Burnett |
| 7,254,242 | B2 | 8/2007 | Ise et al. |
| 7,359,520 | B2 | 4/2008 | Brennan et al. |
| 7,412,379 | B2 | 8/2008 | Taori et al. |
| 2001/0016020 | A1 | 8/2001 | Gustafsson et al. |
| 2001/0031053 | A1 | 10/2001 | Feng et al. |
| 2002/0002455 | A1 | 1/2002 | Accardi et al. |
| 2002/0009203 | A1 | 1/2002 | Erten |
| 2002/0041693 | A1 | 4/2002 | Matsuo |
| 2002/0080980 | A1 | 6/2002 | Matsuo |
| 2002/0106092 | A1 | 8/2002 | Matsuo |
| 2002/0116187 | A1 | 8/2002 | Erten |
| 2002/0133334 | A1 | 9/2002 | Coorman et al. |
| 2002/0147595 | A1 | 10/2002 | Baumgarte |
| 2002/0184013 | A1 | 12/2002 | Walker |
| 2003/0014248 | A1 | 1/2003 | Vetter |
| 2003/0026437 | A1 | 2/2003 | Janse et al. |
| 2003/0033140 | A1 | 2/2003 | Taori et al. |
| 2003/0039369 | A1 | 2/2003 | Bullen |
| 2003/0040908 | A1 | 2/2003 | Yang et al. |
| 2003/0061032 | A1 | 3/2003 | Gonopolskiy |
| 2003/0063759 | A1 | 4/2003 | Brennan et al. |
| 2003/0072382 | A1 | 4/2003 | Raleigh et al. |
| 2003/0072460 | A1 | 4/2003 | Gonopolskiy et al. |
| 2003/0095667 | A1 | 5/2003 | Watts |
| 2003/0099345 | A1 | 5/2003 | Gartner et al. |
| 2003/0101048 | A1 | 5/2003 | Liu |
| 2003/0103632 | A1 | 6/2003 | Goubran et al. |
| 2003/0128851 | A1 | 7/2003 | Furuta |
| 2003/0138116 | A1 | 7/2003 | Jones et al. |
| 2003/0147538 | A1 | 8/2003 | Elko |
| 2003/0169891 | A1 | 9/2003 | Ryan et al. |
| 2003/0228023 | A1 | 12/2003 | Burnett |
| 2004/0013276 | A1 | 1/2004 | Ellis et al. |
| 2004/0047464 | A1 | 3/2004 | Yu et al. |
| 2004/0057574 | A1 | 3/2004 | Faller |

| | | | |
|---|---|---|---|
| 2004/0078199 | A1 | 4/2004 | Kremer et al. |
| 2004/0131178 | A1 | 7/2004 | Shahaf et al. |
| 2004/0133421 | A1 | 7/2004 | Burnett et al. |
| 2004/0165736 | A1 | 8/2004 | Hetherington et al. |
| 2004/0196989 | A1 | 10/2004 | Friedman et al. |
| 2004/0263636 | A1 | 12/2004 | Cutler et al. |
| 2005/0025263 | A1 | 2/2005 | Wu |
| 2005/0027520 | A1 | 2/2005 | Mattila et al. |
| 2005/0049864 | A1 | 3/2005 | Kaltenmeier et al. |
| 2005/0060142 | A1 | 3/2005 | Visser et al. |
| 2005/0152559 | A1 | 7/2005 | Gierl et al. |
| 2005/0185813 | A1 | 8/2005 | Sinclair et al. |
| 2005/0213778 | A1 | 9/2005 | Buck et al. |
| 2005/0216259 | A1 | 9/2005 | Watts |
| 2005/0228518 | A1 | 10/2005 | Watts |
| 2005/0276423 | A1 | 12/2005 | Aubauer et al. |
| 2005/0288923 | A1 | 12/2005 | Kok |
| 2006/0072768 | A1 | 4/2006 | Schwartz et al. |
| 2006/0074646 | A1 | 4/2006 | Alves et al. |
| 2006/0098809 | A1 | 5/2006 | Nongpiur et al. |
| 2006/0120537 | A1 | 6/2006 | Burnett et al. |
| 2006/0133621 | A1 | 6/2006 | Chen et al. |
| 2006/0149535 | A1 | 7/2006 | Choi et al. |
| 2006/0184363 | A1 | 8/2006 | McCree et al. |
| 2006/0198542 | A1 | 9/2006 | Benjelloun Touimi et al. |
| 2006/0222184 | A1 | 10/2006 | Buck et al. |
| 2007/0021958 | A1 | 1/2007 | Visser et al. |
| 2007/0027685 | A1 | 2/2007 | Arakawa et al. |
| 2007/0033020 | A1 | 2/2007 | Francois et al. |
| 2007/0067166 | A1 | 3/2007 | Pan et al. |
| 2007/0078649 | A1 | 4/2007 | Hetherington et al. |
| 2007/0094031 | A1 | 4/2007 | Chen |
| 2007/0100612 | A1 | 5/2007 | Ekstrand et al. |
| 2007/0116300 | A1 | 5/2007 | Chen |
| 2007/0150268 | A1 | 6/2007 | Acero et al. |
| 2007/0154031 | A1 | 7/2007 | Avendano et al. |
| 2007/0165879 | A1 | 7/2007 | Deng et al. |
| 2007/0195968 | A1 | 8/2007 | Jaber |
| 2007/0230712 | A1 | 10/2007 | Belt et al. |
| 2007/0276656 | A1 | 11/2007 | Solbach et al. |
| 2008/0019548 | A1 | 1/2008 | Avendano |
| 2008/0033723 | A1 | 2/2008 | Jang et al. |
| 2008/0140391 | A1 | 6/2008 | Yen et al. |
| 2008/0201138 | A1 | 8/2008 | Visser et al. |
| 2008/0228478 | A1 | 9/2008 | Hetherington et al. |
| 2008/0260175 | A1 | 10/2008 | Elko |
| 2009/0012783 | A1 | 1/2009 | Klein |
| 2009/0012786 | A1 | 1/2009 | Zhang et al. |
| 2009/0129610 | A1 | 5/2009 | Kim et al. |
| 2009/0220107 | A1 | 9/2009 | Every et al. |
| 2009/0238373 | A1 | 9/2009 | Klein |
| 2009/0253418 | A1 | 10/2009 | Makinen |
| 2009/0271187 | A1 | 10/2009 | Yen et al. |
| 2009/0323982 | A1 | 12/2009 | Solbach et al. |
| 2010/0094643 | A1 | 4/2010 | Avendano et al. |
| 2010/0278352 | A1 | 11/2010 | Petit et al. |
| 2011/0178800 | A1 | 7/2011 | Watts |

FOREIGN PATENT DOCUMENTS

| | | |
|---|---|---|
| JP | 04184400 | 7/1992 |
| JP | 05053587 | 3/1993 |
| JP | 06269083 | 9/1994 |
| JP | 10-313497 | 11/1998 |
| JP | 11-249693 | 9/1999 |
| JP | 2005110127 | 4/2005 |
| JP | 2005195955 | 7/2005 |
| WO | 01/74118 | 10/2001 |
| WO | 03/043374 | 5/2003 |
| WO | 03/069499 | 8/2003 |
| WO | 2007/081916 | 7/2007 |
| WO | 2007/114003 | 12/2007 |
| WO | 2007/140003 | 12/2007 |
| WO | 2010/005493 | 1/2010 |

OTHER PUBLICATIONS

Tchorz et al., "SNR Estimation Based on Amplitude Modulation Analysis with Applications to Noise Suppression", source(s): IEEE Transactions on Speech and Audio Processing, vol. 11, No. 3, May 2003, pp. 184-192.

Stahl et al., "Quantile Based Noise Estimation for Spectral Substraction and Wiener Filtering", source(s): IEEE, 2000, pp. 1875-1878.

Yoo et al., "Continuous-Time Audio Noise Suppression and Real-Time Implementation", source(s): IEEE, 2002, pp. IV3980-IV3983.

Steven Boll, "Suppression of Acoustic Noise in Speech using Spectral Substraction", source(s): IEEE Transactions on Acoustics, Speech and Signal Processing, vol. ASSP-27, No. 2, Apr. 1979, pp. 113-120.

Dahl et al., "Simultaneous Echo Cancellation and Car Noise Suppression Employing a Microphone Array", source(s): IEEE, 1997, pp. 293-382.

Graupe et al., "Blind Adaptive Filtering of Speech from Noise of Unknown Spectrum Using Virtual Feedback Configuration", source(s): IEEE, 2000, pp. 146-158.

Fulghum et al., "LPC Voice Digitizer with Background Noise Suppression", source(s): IEEE, 1979, pp. 220-223.

Marc Moonen et al. "Multi-Microphone Signal Enhancement Techniques for Noise Suppression and Dereverberation," source(s): http://www.esat.kuleuven.ac.be/sista/yearreport97/node37.html.

Steven Boll et al. "Suppression of Acoustic Noise in Speech Using Two Microphone Adaptive Noise Cancellation", source(s): IEEE Transactions on Acoustic, Speech, and Signal Processing, vol. v ASSP-28, n 6, Dec. 1980, pp. 752-753.

Chen Liu et al. "A two-microphone dual delay-line approach for extraction of a speech sound in the presence of multiple interferers", source(s): Acoustical Society of America. vol. 110, 6, Dec. 2001, pp. 3218-3231.

Cohen et al. "Microphone Array Post-Filtering for Non-Stationary Noise", source(s): IEEE. May 2002.

Jindong Chen et al. "New Insights into the Noise Reduction Wiener Filter", source(s): IEEE Transactions on Audio, Speech, and Langauge Processing. vol. 14, 4, Jul. 2006, pp. 1218-1234.

Rainer Martin et al. "Combined Acoustic Echo Cancellation, Dereverberation and Noise Reduction: A two Microphone Approach", source(s): Annales des Telecommunications/Annals of Telecommunications. vol, 29, 7-8, Jul.-Aug. 1994, pp. 429-438.

Mitsunori Mizumachi et al. "Noise Reduction by Paired-Microphones Using Spectral Subtraction", source(s): 1998 IEEE. pp. 1001-1004.

Lucas Parra et al. "Convolutive blind Separation of Non-Stationary" source(s): IEEE Transactions on Speech and Audio Processing. vol. 8, 3, May 2008, pp. 320-327.

Isreal Cohen. "Multichannel Post-Filtering in Nonstationary Noise Environment", source(s): IEEE Transactions on Signal Processing. vol. 52, 5, May 2004, pp. 1149-1160.

R.A. Goubran. "Acoustic Noise Suppression Using Regressive Adaptive Filtering", source(s): 1990 IEEE. pp. 48-53.

Ivan Tashev et al. "Microphone Array of Headset with Spatial Noise Suppressor", source(s): http://research.microsoft.com/users/ivantash/Documents/Tashev_MAforHeadset_HSCMA_05.pdf. (4 pages).

Martin Fuchs et al. "Noise Suppression for Automotive Applications Based on Directional Information", source(s): 2004 IEEE pp. 237-240.

Jean-Marc Valin et al. "Enhanced Robot Audition Based on Microphone Array Source Separation with Post-Filter", source(s): Proceedings of 2004 IEEE/RSJ International Conference on Intelligent Robots and Systems, Sep. 28-Oct. 2, 2004, Sendai, Japan. pp. 2123-2128.

Jont B. Allen. "Short Term Spectral Analysis, Synthesis, and Modification by Discrete Fourier Transform", IEEE Transactions on Acoustics, Speech, and Signal Processing, vol. ASSP-25, 3. Jun. 1977. pp. 235-238.

Jont B. Allen et al. "A Unified Approach to Short-Time Fourier Analysis and Synthesis", Proceedings of the IEEE. vol. 65, 11, Nov. 1977. pp. 1558-1564.

C. Avendano, "Frequency-Domain Techniques for Source Identification and Manipulation in Stereo Mixes for Enhancement, Suppression and Re-Panning Applications," in Proc. IEEE Workshop on Application of Signal Processing to Audio and Acoustics, Waspaa, 03, New Paltz, NY, 2003.
B. Widrow et al., "Adaptive Antenna Systems," Proceedings IEEE, vol. 55, No. 12, pp. 2143-2159, Dec. 1967.
Boll, Steven F. "Suppression of Acoustic Noise in Speech Using Spectral Subtraction", Dept. of Computer Science, University of Utah Salt Lake City, Utah, Apr. 1979, pp. 18-19.
"ENT 172." Instructional Module. Prince George's Community College Department of Engineering Technology Accessed: Oct. 15, 2011. Subsection: "Polar and Rectangular Notation". <http://academic.ppgoc.edu/ent/ent/ent172_instr_mod.html>.
Haykin, Simon et al. "Appendix A.2 Complex Numbers." Signals and Systems. 2nd ed. 2003. p. 764.
Hermansky, Hynek "Should Recognizers Have Ears?", In Proc. ESCA Tutorial and Research Workshop on Robust Speech Recognition for Unknown Communication Channles, pp. 1-10, France 1997.
Hohmann, V. "Frequency Analysis and Synthesis Using a Gammatone Filterbank", ACTA Acustica United with Acustica, 2002, vol. 88, pp. 433-442.
Jeffress, "A Place Theory of Sound Localization," The Journal of Comparative and Physiological Psychology, 1948, vol. 41, pp. 35-39.
Jeong, Hyuk et al., "Implementation of a New Algorithm Using the STFT with Variable Frequency Resolution for the Time-Frequency Auditory Model", J. Audio Eng. Soc., Apr. 1999, vol. 47, No. 4., pp. 240-251.
Kates, James M. "A Time Domain Digital Cochlear Model", IEEE Transactions on Signal Proccessing, Dec. 1991, vol. 39, No. 12, pp. 2573-2592.
Lazzaro et al., "A Silicon Model of Auditory Localization," Neural Computation 1, 47-57, 1989, Massachusetts Institute of Technology.
Lippmann, Richard P. "Speech Recognition by Machines and Humans", Speech Communication 22(1997) 1-15, 1997 Elseiver Science B.V.
Martin, R "Spectral subtraction based on minimum statistics," in Proc. Eur. Signal Processing Conf., 1994, pp. 1182-1185.
Mitra, Sanjit K. Digital Signal Processing: a Computer-based Approach. 2nd ed. 2001. pp. 131-133.
Narrative of Prior Disclosure of Audio Display, Feb. 15, 2000.
Cosi, P. et al (1996). "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Rabiner, Lawrence R. et al. Digital Processing of Speech Signals (Prentice-Hall Series in Signal Processing). Upper Saddle River, NJ: Prentice Hall, 1978.
Weiss Ron et al, Estimating single-channel source separation masks:revelance vector machine classifiers vs. pitch-based masking Workshop on Statistical and Preceptual Audio Processing, 2006.
Schimmel, Steven et al., "Coherent Envelope Detection for Modulation Filtering of Speech," ICASSP 2005, I-221-1224, 2005 IEEE.
Slaney, Malcom, "Lyon's Cochlear Model", Advanced Technology Group, Apple Technical Report #13, AppleComputer, Inc., 1988, pp. 1-79.
Slaney, Malcom, et al. (1994). "Auditory model inversion for sound separation " Proc. of IEEE Intl. Conf. on Acous., Speech and Sig. Proc., Sydney, vol. II, 77-80.
Slaney, Malcom. "An Introduction to Auditory Model Inversion," Interval Technical Report IRC 1994-014, http://coweb.ecn.purdue.edu/~maclom/interval/1994-014/,Sep. 1994.
Solbach, Ludger "An Architecture for Robust Partial Tracking and Onset Localization in Single Channel Audio Signal Mixes", Tuhn Technical University, Hamburg and Harburg, ti6 Verteilte Systeme, 1998.
Syntrillium Software Corporation, "Cool Edit User's Manual," 1996,. pp. 1-74.
Watts "Robust Hearing Systems for Intelligent Machines," Applied Neurosystems Corporation, 2001, pp. 1-5.
International Search Report dated Jun. 8, 2001 in Application No. PCT/US01/08372.
International Search Report dated Apr. 3, 2003 in Application No. PCT/US02/36946.
International Search Report dated May 29, 2003 in Application No. PCT/US03/04124.
International Search Report and Writien Opinion dated Oct. 19, 2007 in Application No. PCT/US07/00463.
International Search Report and Written Opinion dated Apr. 9, 2008 in Application No. PCT/US07/21654.
International Search Report and Written Opinion dated Sep. 16, 2008 in Application No. PCT/US07/12628.
International Search Report and Written Opinion dated Oct. 1, 2008 in Application No. PCT/US08/08249.
International Search Report and Written Opinion dated May 11, 2009 in Application No. PCT/US09/01667.
International Search Report and Written Opinion dated Aug. 27, 2009 in Application No. PCT/US09/03813.
International Search Report and Written Opinion dated May 20, 2010 in Application No. PCT/US09/06754.
US Reg. No. 2,875,755 (Aug. 17, 2004).
Demol, M. et al. "Efficient Non-Uniform Time-Scaling of Speech With WSOLA for CALL Applications", Proceedings of InSTIL/ICALL2004—NLP and Speech Technologies in Advanced Language Learning Systems—Venice Jun. 17-19, 2004.
Laroche, "Time and Pitch Scale Modification of Audio Signals", in "Applications of Digital Signal Processing to Audio and Acoustics", The Kluwer International Series in Engineering and Computer Science, vol. 437, pp. 279-309, 2002.
Moulines, Eric et al., "Non-Parametric Techniques for Pitch-Scale and Time-Scale Modification of Speech", Speech Communication, vol. 16, pp. 175-205, 1995.
Verhelst, Werner, "Overlap-Add Methods for Time-Scaling of Speech", Speech Communication vol. 30, pp. 207-221, 2000.

SYSTEM AND METHOD FOR ADAPTIVE CLASSIFICATION OF AUDIO SOURCES

CROSS-REFERENCE TO RELATED APPLICATION

The present application is related to U.S. patent application Ser. No. 11/825,563 filed Jul. 6, 2007 and entitled "System and Method for Adaptive Intelligent Noise Suppression," U.S. patent application Ser. No. 11/343,524, filed Jan. 30, 2006 and entitled "System and Method for Utilizing Inter-Microphone Level Differences for Speech Enhancement," and U.S. patent application Ser. No. 11/699,732 filed Jan. 29, 2007 and entitled "System And Method For Utilizing Omni-Directional Microphones For Speech Enhancement," all of which are herein incorporated by reference.

BACKGROUND OF THE INVENTION

1. Field of Invention

The present invention relates generally to audio processing and more particularly to adaptive classification of audio sources.

2. Description of Related Art

Currently, there are many methods for reducing background noise in an adverse audio environment. One such method is to use a noise suppression system that always provides an output noise that is a fixed bound lower than the input noise. Typically, the fixed noise suppression is in the range of 12-13 dB. The noise suppression is fixed to this conservative level in order to avoid producing speech distortion, which will be apparent with higher noise suppression.

In order to provide higher noise suppression, dynamic noise suppression systems based on signal-to-noise ratios (SNR) have been utilized. Unfortunately, SNR, by itself, is not a very good predictor of an amount of speech distortion because of the existence of different noise types in the audio environment and the non-statutory nature of a speech source (e.g., people). SNR is a ratio of how much louder speech is than noise. The SNR may be adversely impacted when speech energy (i.e., the signal) fluctuates over a period of time. The fluctuation of the speech energy can be caused by changes of intensity and sequences of words and pauses.

Additionally, stationary and dynamic noises may be present in the audio environment. The SNR averages all of these stationary and non-stationary noises and speech. There is no consideration as to the statistics of the noise signal; only what the overall level of noise is.

In some prior art systems, a fixed classification threshold discrimination system may be used to assist in noise suppression. However, fixed classification systems are not robust. In one example, speech and non-speech elements may be classified based on fixed averages. However, if conditions change, such as when the speaker moves the microphone away from their mouth or noise suddenly gets louder, the fixed classification system will erroneously classify the speech and non-speech elements. As a result, speech elements may be suppressed and overall performance may significantly degrade.

SUMMARY OF THE INVENTION

Systems and methods for adaptively classifying audio sources are provided. In exemplary embodiments, at least one acoustic signal is received. One or more acoustic features based on the at least one acoustic signal are derived. A global summary of acoustic features based, at least in part, on the derived one or more acoustic features, is determined. Further, an instantaneous global classification based on a global running estimate and the global summary of acoustic features is determined. The global running estimates may be updated and an instantaneous local classification based on, at least in part, the one or more acoustic features may be derived. One or more spectral energy classifications based, at least in part, on the instantaneous local classification and the one or more acoustic features may be determined. In some embodiments, the spectral energy classification is provided to a noise suppression system.

In various embodiments, a frame of the primary acoustic signal may be classified based on a global inter-microphone level difference (ILD). The global ILD may be based on a weighting of a maximum energy at each frequency and a local ILD at each frequency. A frame may be classified based on a position of the global ILD relative to a plurality of global clusters. These global clusters may comprise a global (speech) source cluster, a global background cluster, and a global distractor cluster. Similarly, local classification for each frequency of the frame may be performed using local ILDs. In various embodiments, a cluster is an average.

A spectral energy classification may be determined based on the local and frame classifications. The resulting spectral energy classification may then be forwarded to a noise suppression system for use. The spectral energy classification may be used by a noise estimate module to determine a noise estimate for each frequency band and an overall noise spectrum for the acoustic signal. An adaptive intelligent suppression generator may use the noise spectrum and a power spectrum of the primary acoustic signal to estimate speech loss distortion (SLD). The SLD estimate may be used to derive control signals which adaptively adjust an enhancement filter. The enhancement filter may be utilized to generate a plurality of gains or gain masks, which may be applied to the primary acoustic signal to generate a noise suppressed signal.

DESCRIPTION OF EXEMPLARY EMBODIMENTS

The present invention provides exemplary systems and methods for adaptive classification of an audio source. Speech is typically louder than non-speech. Local observations (specific to one frequency) may be least reliable when speech and non-speech components of the signal are approximately equal. As a result, local observations are used when there is evidence that suggested the local observations are dominated by either speech or non-speech. This evidence may be provided by a more reliable global acoustic feature.

When the global acoustic feature is speech, local acoustic features dominated by speech are more likely to be accurate. When the global acoustic feature is non-speech, the local acoustic features dominated by non-speech are more likely to be accurate.

In various embodiments, an acoustic feature may be measured independently at each frequency of at least one acoustic signal. The distribution of the acoustic feature may vary in a predictable way depending on whether the energy at that frequency is dominated by energy from a wanted (speech/signal) or unwanted (noise/distractor) source. The input energy spectrum may alternate between being dominated by higher-energy wanted energy (wanted speech) and being dominated by unwanted energy. A global energy weighted summary will likewise vary in a predictable way between two distributions and can be used to classify frames as wanted-dominated, unwanted-dominated, or indeterminate. Since the local observations of the acoustic feature are typically noisier than this global summary, the global summary may be used to determine whether the local observations are used to update the local estimates (e.g., clusters) of distributions of unwanted and wanted values. An update may be done when local and global measures agree. The spectrum may be classified based on the relation of the observations (and energy-weighted global summary) and the wanted and unwanted distributions (and global versions of the same).

Embodiments of the present invention may be practiced on any audio device that is configured to receive sound such as, but not limited to, cellular phones, phone handsets, headsets, and conferencing systems. Advantageously, exemplary embodiments are configured to provide improved noise suppression while minimizing speech degradation. While some embodiments of the present invention will be described in reference to operation on a cellular phone, the present invention may be practiced on any audio device.

Figure 1:
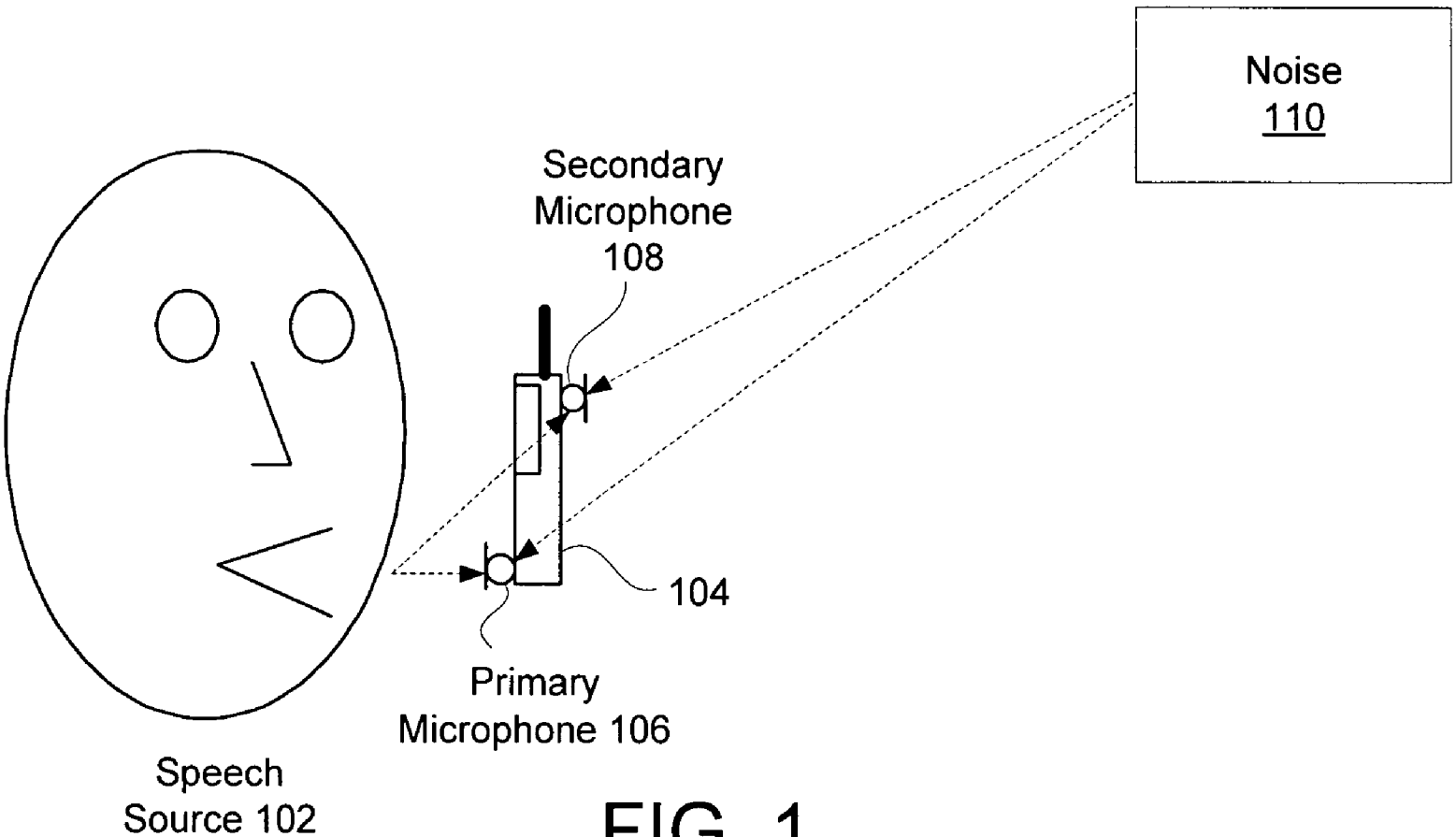
FIG. 1 is an environment in which embodiments of the present invention may be practiced.

Referring to FIG. 1, an environment in which embodiments of the present invention may be practiced is shown. A user acts as a speech source 102 to an audio device 104. The exemplary audio device 104 comprises two microphones: a primary microphone 106 relative to the audio source 102 and a secondary microphone 108 located a distance away from the primary microphone 106. In some embodiments, the microphones 106 and 108 comprise omni-directional microphones. In various embodiments, the audio device 104 comprises a cellular telephone or any other kind of device configured to receive acoustic signals.

While the microphones 106 and 108 receive sound (i.e., acoustic signals) from the audio source 102, the microphones 106 and 108 also pick up noise 110. Although the noise 110 is shown coming from a single location in FIG. 1, the noise 110 may comprise any sounds from one or more locations different than the audio source 102, and may include reverberations, echoes, and distractors. The noise 110 may be stationary, non-stationary, and/or a combination of both stationary and non-stationary noise.

In various embodiments of the present invention one or more acoustic factors (cues) regarding the acoustic. An acoustic feature is a feature that provides information about the likely sources of audio energy (e.g., associated with one or more acoustic signals). For example, the value of a given acoustic feature may be higher for speech than for non-speech.

For example, the acoustic feature may comprise time and/or frequency varying features. There may be any number of acoustic features determined based on one or more acoustic signals. In various embodiments, the use of multiple acoustic features may add robustness to some embodiments of the present invention.

Some embodiments of the present invention utilize level differences (e.g., energy differences) as an acoustic feature between the acoustic signals received by the two microphones 106 and 108. Because the primary microphone 106 is much closer to the speech source 102 than the secondary microphone 108, the intensity level is higher for the primary microphone 106 resulting in a larger energy level during a speech/voice segment, for example.

The level difference may then be used to discriminate speech and noise in the time-frequency domain. Further embodiments may use a combination of energy level differences and time delays to discriminate speech. Based on binaural cue decoding, speech signal extraction or speech enhancement may be performed.

Although a primary and a secondary acoustic signal is discussed in various examples, those skilled in the art will appreciate that there may be only one acoustic signal (e.g., the primary acoustic signal) or any number of acoustic signals. In one example, there is only a single acoustic signal and the acoustic feature may be a level difference associated with the single acoustic signal.

Similarly, those skilled in the art will appreciate that there may be any number of acoustic features determined based on one or more acoustic signals. In one example, one acoustic feature may comprise an inter-level difference (ILD). In another example, the acoustic feature may comprise a time difference or phase difference.

Figure 2:
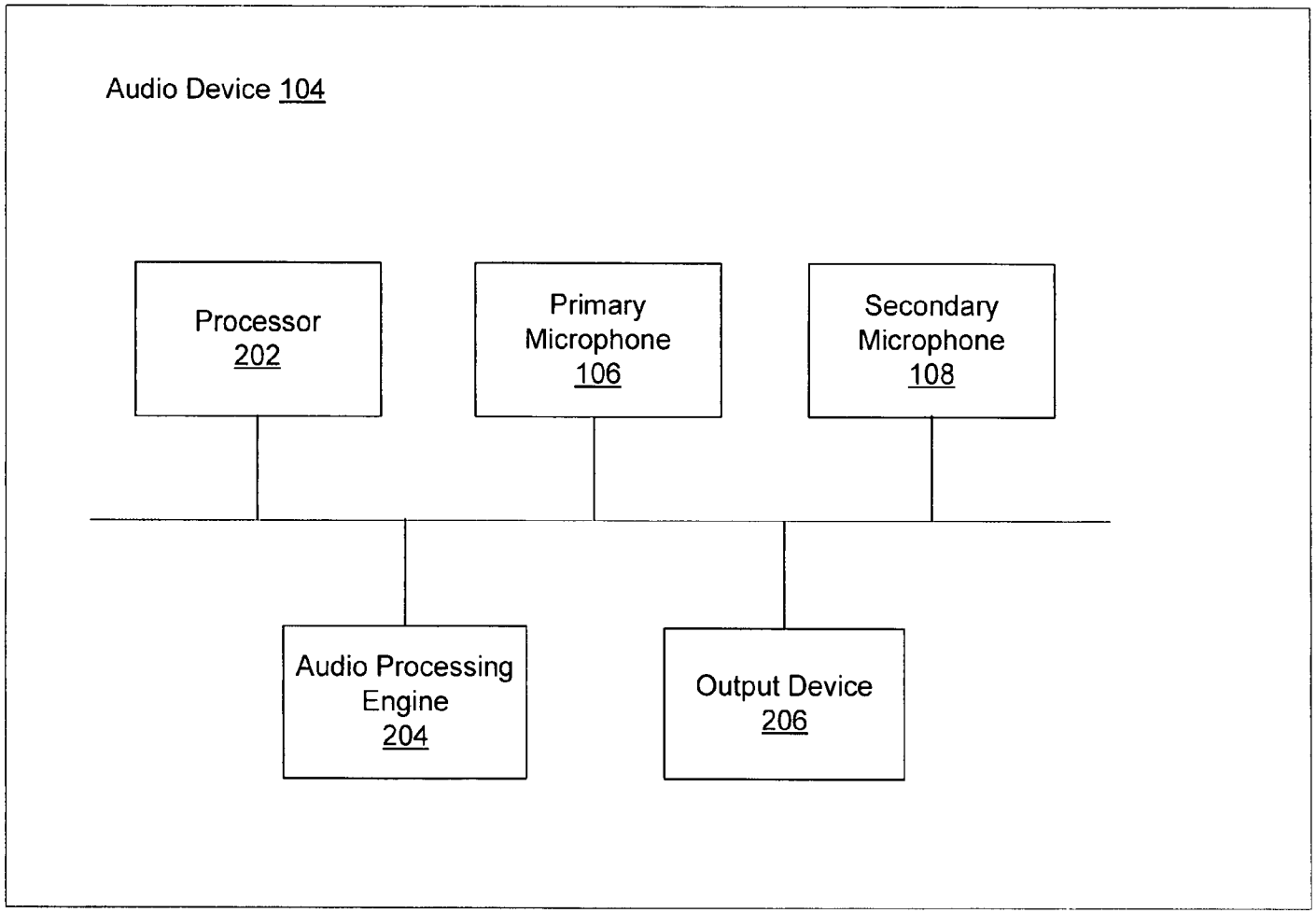
FIG. 2 is a block diagram of an exemplary audio device implementing embodiments of the present invention.

Referring now to FIG. 2, the exemplary audio device 104 is shown in more detail. In exemplary embodiments, the audio device 104 is an audio receiving device that comprises a processor 202, the primary microphone 106, the secondary microphone 108, an audio processing engine 204, and an output device 206. The audio device 104 may comprise further components necessary for audio device 104 operations. The audio processing engine 204 will be discussed in more details in connection with FIG. 3.

As previously discussed, the primary and secondary microphones 106 and 108, respectively, are spaced a distance apart in order to allow for an energy level differences between them. Upon reception by the microphones 106 and 108, the acoustic signals are converted into electric signals (i.e., a primary electric signal and a secondary electric signal). The electric signals may themselves be converted by an analog-to-digital converter (not shown) into digital signals for processing in accordance with some embodiments. In order to differentiate the acoustic signals, the acoustic signal received by the primary microphone 106 is herein referred to as the primary acoustic signal, while the acoustic signal received by the secondary microphone 108 is herein referred to as the secondary acoustic signal. It should be noted that embodiments of the present invention may be practiced utilizing only a single microphone (i.e., the primary microphone 106).

The output device 206 is any device which provides an audio output to the user. For example, the output device 206 may comprise an earpiece of a headset or handset, or a speaker on a conferencing device.

Figure 3:
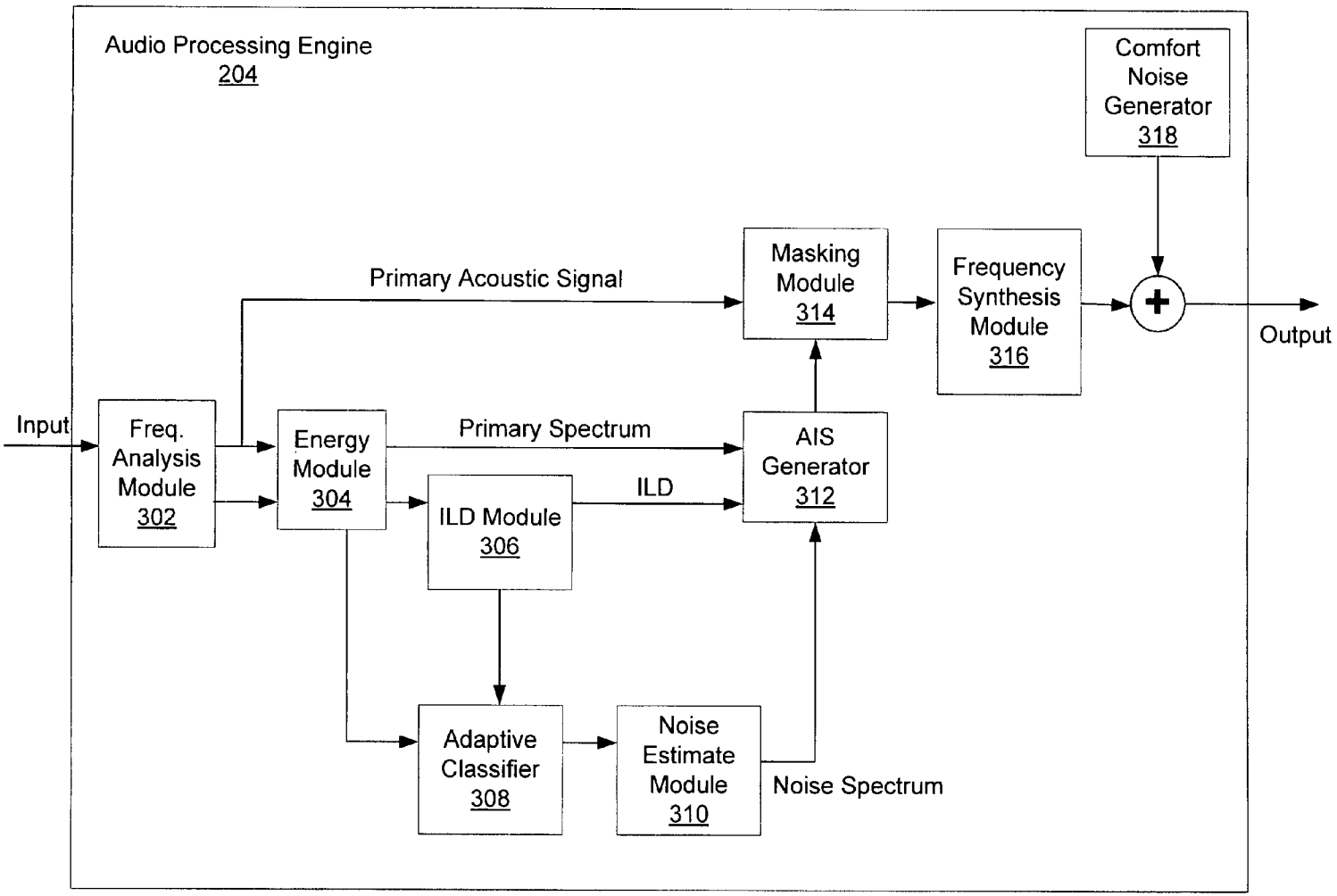
FIG. 3 is a block diagram of an exemplary audio processing engine.

FIG. 3 is a detailed block diagram of the exemplary audio processing engine 204, according to one embodiment of the present invention. In exemplary embodiments, the audio processing engine 204 is embodied within a memory device and/or one or more integrated circuits. In operation, the acoustic signals received from the primary and secondary microphones 106 and 108 are converted to electric signals and processed through a frequency analysis module 302. In one embodiment, the frequency analysis module 302 takes the acoustic signals and mimics the frequency analysis of a cochlea (i.e., cochlear domain) simulated by a filter bank. In one example, the frequency analysis module 302 separates the acoustic signals into frequency bands. Alternatively, other filters such as short-time Fourier transform (STFT), sub-band filter banks, modulated complex lapped transforms, cochlear models, wavelets, etc., can be used for the frequency analysis and synthesis. Because most sounds (e.g., acoustic signals) are complex and comprise more than one frequency, a sub-band analysis on the acoustic signal may be performed to determine what individual frequencies are present in the acoustic signal during a frame (e.g., a predetermined period of time). According to one embodiment, the frame is 8 milliseconds long. Alternative embodiments may utilize other frame lengths.

After frequency analysis, the signals are forwarded to an energy module 304 which computes energy/power estimates during an interval of time for each frequency band (i.e., power estimates) of the acoustic signal. In embodiments utilizing two microphones, power spectrums of both the primary and secondary acoustic signals may be determined. The primary spectrum comprises the power spectrum from the primary acoustic signal (from the primary microphone 106), which contains both speech and noise. As a result, a primary spectrum (i.e., a power spectral density of the primary acoustic signal) across all frequency bands may be determined by the energy module 304. This primary spectrum may be supplied to an adaptive intelligent suppression (AIS) generator 312, an inter-microphone level difference (ILD) module 306, and an adaptive classifier 308. In exemplary embodiments, the primary acoustic signal is the signal which will be filtered in the AIS generator 312. Similarly, the energy module 304 may determine a secondary spectrum (i.e., a power spectral density of the secondary acoustic signal) across all frequency bands to be supplied to the ILD module 306 and the adaptive classifier 308. More details regarding the calculation of power estimates and power spectrums can be found in co-pending U.S. patent application Ser. No. 11/343,524 and co-pending U.S. patent application Ser. No. 11/699,732, which are incorporated by reference.

In two microphone embodiments, the power spectrums may be used by the ILD module 306 to determine a time and frequency varying ILD. Because the primary and secondary microphones 106 and 108 may be oriented in a particular way, certain level differences may occur when speech is active and other level differences may occur when noise is active. The ILD is then forwarded to the adaptive classifier 308 and the AIS generator 312. More details regarding the calculation of ILD may be can be found in co-pending U.S. patent application Ser. No. 11/343,524 and co-pending U.S. patent application Ser. No. 11/699,732.

In some embodiments, the ILD module 306 determines local ILDs. In one example, the ILD module 306 may determine a local ILD for each frequency band (i.e., power estimates) of the acoustic signal. A local ILD may be an observation of the ILD for a frequency band.

The exemplary adaptive classifier 308 is configured to differentiate noise and distractors (e.g., sources with a negative ILD) from speech in the acoustic signal(s) for each frequency band in each frame. In one example, a distractor may be generated when the secondary microphone 108 is closer to the speech source 102 than the primary microphone 106.

The adaptive classifier 308 is adaptive because features (e.g., speech, noise, and distractors) change and are dependent on acoustic conditions in the environment. For example, an ILD that indicates speech in one situation may indicate noise in another situation. Therefore, the adaptive classifier 308 adjusts classification boundaries based on the ILD and output spectral energy data based on the classification. The adaptive classifier 308 will be discussed in more details in connection with FIGS. 4 and 5 below. The results from the adaptive classifier 308 are then provided to a noise suppression system, which may comprise the noise estimate module 310, AIS generator 312, and masking module 314.

In some embodiments, the noise estimate is based on the acoustic signal from the primary microphone 106. The exemplary noise estimate module 310 is a component which can be approximated mathematically by $$N(t,\omega)=\lambda_1(t,\omega)E_1(t,\omega)+(1-\lambda_1(t,\omega))\min[N(t-1,\omega),E_1(t,\omega)]$$

according to one embodiment of the present invention. As shown, the noise estimate in this embodiment is based on minimum statistics of a current energy estimate of the primary acoustic signal, $E_1(t,\omega)$, and a noise estimate of a previous time frame, $N(t-1,\omega)$. As a result, the noise estimation is performed efficiently and with low latency.

$\lambda_1(t,\omega)$ in the above equation is derived from the ILD approximated by the ILD module 306, as $$\lambda_l(t,\omega)=\begin{cases}\approx 0 & \text{if } ILD(t,\omega)<\text{threshold}\\ \approx 1 & \text{if } ILD(t,\omega)>\text{threshold}\end{cases}$$

That is, when the $ILD(t,\omega)$ is smaller than a threshold value (e.g., threshold=0.5) less than what speech is expected to be, $\lambda_1$ is small, and thus the noise estimate module 310 follows the noise closely. When ILD starts to rise (e.g., because speech is present within the large ILD region), $\lambda_1$ increases. As a result, the noise estimate module 310 slows down the noise estimation process and the speech energy may not contribute significantly to the final noise estimate. Therefore, exemplary embodiments of the present invention may use a combination of minimum statistics and voice activity detection to determine the noise estimate. In various embodiments, the noise estimate module 310 uses the classified spectral energy of the noise as determined by the adaptive classifier 308. A noise spectrum (i.e., noise estimates for all frequency bands of an acoustic signal) is then forwarded to the AIS generator 312.

According to an exemplary embodiment of the present invention, the adaptive intelligent suppression (AIS) generator 312 derives time and frequency varying gains or gain masks used to suppress noise and enhance speech. In order to derive the gain masks, however, specific inputs are needed for the AIS generator 312. These inputs comprise the power spectral density of noise (i.e., noise spectrum), the power spectral density of the primary acoustic signal (i.e., primary spectrum), and the inter-microphone level difference (ILD).

Speech loss distortion (SLD) may be based on both the estimate of a speech level and the noise spectrum. The AIS generator 312 receives both the speech and noise spectrum of the primary spectrum from the energy module 304 as well as the noise spectrum from the noise estimate module 310. Based on these inputs and an optional ILD from the ILD module 306, a speech spectrum may be inferred; that is the noise estimates of the noise spectrum may be subtracted out from the power estimates of the primary spectrum. In exemplary embodiments, the noise estimate module 310 determines the noise spectrum based on the classifications of spectral energy received form the adaptive classifier 308. Subsequently, the AIS generator 312 may determine gain masks to apply to the primary acoustic signal. More details regarding the AIS generator 312 may be found in co-pending U.S. patent application Ser. No. 11/825,563 filed Jul. 6, 2007 and entitled "System and Method for Adaptive Intelligent Noise Suppression."

The SLD is a time varying estimate. In exemplary embodiments, the system may utilize statistics from a predetermined, settable amount of time (e.g., two seconds) of the acoustic signal. If noise or speech changes over the next few seconds, the system may adjust accordingly.

In exemplary embodiments, the gain mask output from the AIS generator 312, which is time and frequency dependent, will maximize noise suppression while constraining the SLD. Accordingly, each gain mask is applied to an associated frequency band of the primary acoustic signal in a masking module 314.

Next, the masked frequency bands are converted back into time domain from the cochlea domain. The conversion may comprise taking the masked frequency bands and adding together phase shifted signals of the cochlea channels in a frequency synthesis module 316. Once conversion is completed, the synthesized acoustic signal may be output to the user.

In some embodiments, comfort noise generated by a comfort noise generator 318 may be added to the signal prior to output to the user. Comfort noise comprises a uniform, constant noise that is not usually discernable to a listener (e.g., pink noise). This comfort noise may be added to the acoustic signal to enforce a threshold of audibility and to mask low-level non-stationary output noise components. In some embodiments, the comfort noise level may be chosen to be just above a threshold of audibility and may be settable by a user. In exemplary embodiments, the AIS generator 312 may know the level of the comfort noise in order to generate gain masks that will suppress the noise to a level below the comfort noise.

It should be noted that the system architecture of the audio processing engine 204 of FIG. 3 is exemplary. Alternative embodiments may comprise more components, less components, or equivalent components and still be within the scope of embodiments of the present invention. Various modules of the audio processing engine 204 may be combined into a single module. For example, the functionalities of the frequency analysis module 302 and energy module 304 may be combined into a single module. As a further example, the functions of the ILD module 306 may be combined with the functions of the energy module 304 alone, or in combination with the frequency analysis module 302.

Figure 4:
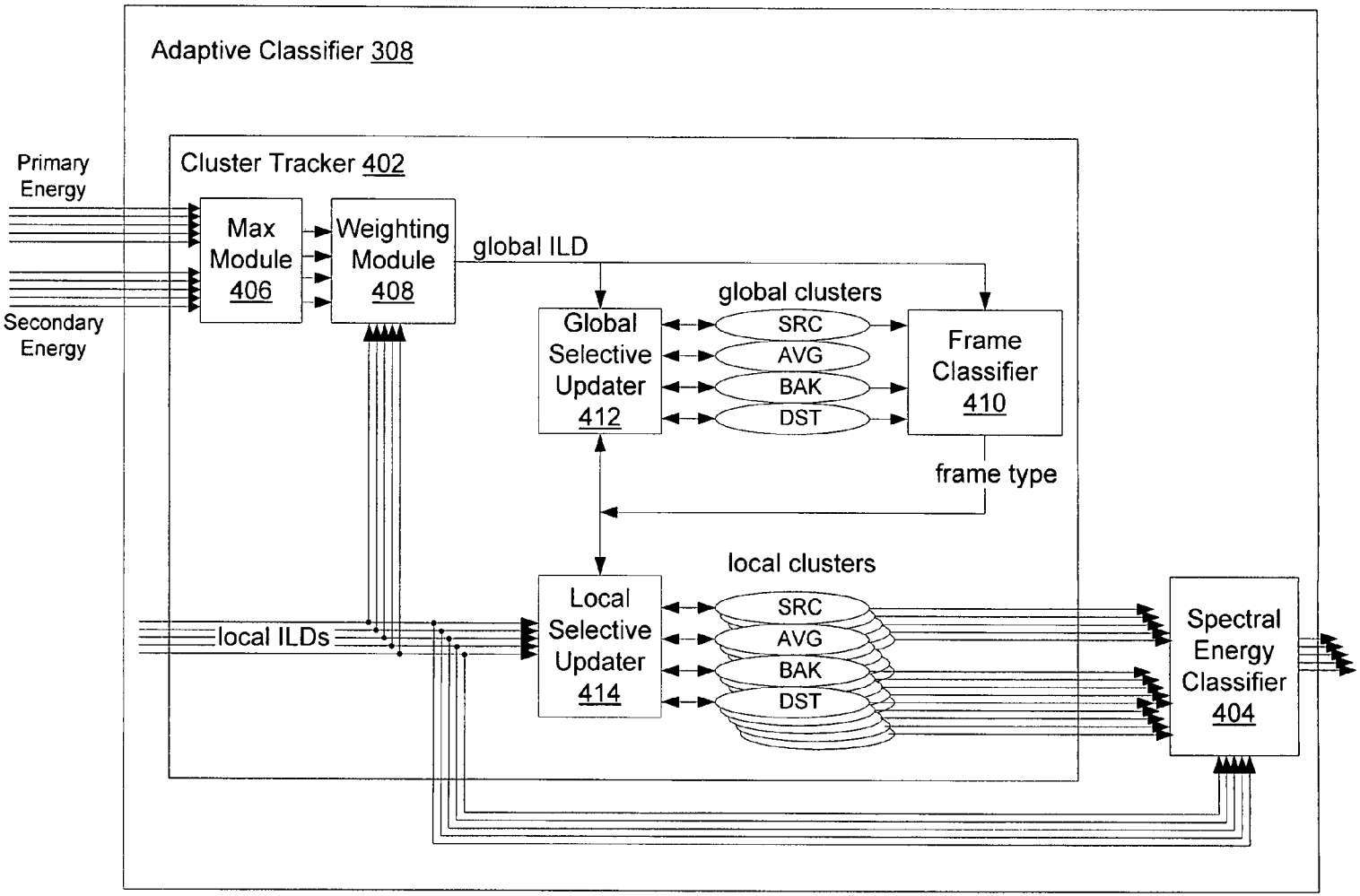
FIG. 4 is a block diagram of an exemplary adaptive classifier.

Referring now to FIG. 4, the exemplary adaptive classifier 308 is shown in more detail. According to exemplary embodiments, the adaptive classifier 308 differentiates (i.e., classifies) noise and distractors from speech and provides the results to the noise estimate module 310 in order to derive the noise estimate. Because the adaptive classifier 308 is a flexible classifier, the adaptive classifier 308 does not need to have a predefined fixed classification scheme. That is, the adaptive classifier 308 may track through any range. In exemplary embodiments, the adaptive classifier 308 comprises a cluster tracker 402 and a spectral energy classifier 404.

In various embodiments, speech is distinguished from noise or other unwanted sounds by extracting time and frequency varying features from the acoustic signal and comparing these features to estimates of expected values of those features for speech and noise. Runtime-varying factors (e.g., handset position, microphones not perfectly matched, noise sources not equidistant from both microphones, etc.) can significantly affect values of these features. Even with severe ILD distortion, however, certain ILD distribution patterns are applicable. For example, ILD sources close to the primary microphone 106 are usually higher than ILDs from distant sources (e.g., noise). In some examples, ILDs from a source close to the primary microphone 106 is usually clustered near a value of one when the SNR is high, and ILDs of distant sources (e.g., noise) typically cluster close to zero.

ILD distortion, in many embodiments, may be created by either fixed (e.g., from irregular or mismatched microphone response) or slowly changing (e.g., changes in handset, talker, or room geometry and position) causes. In these embodiments, the ILD distortion may be compensated for based on estimates for either build-time clarification or runtime tracking. Exemplary embodiments of the present invention provides the cluster tracker 402 to dynamically calculate these estimates at runtime providing a per-frequency dynamically changing estimate for a source (e.g., speech) and a noise (e.g., background) ILDs.

In order to track ILDs of two sound sources, a determination of how much a given ILD observation affects an ILD estimate of each source may performed by the cluster tracker 402. In exemplary embodiments, a given observation either affects the ILD estimate of at most one source (e.g., speech or noise source), or it may have no effect. This results in a "classification" that may be based on two assumptions. The first assumption is that speech may alternate between high and low levels of energy (e.g., when the user speaks and pauses between words). The second assumption is that an energy weighted average ILD (i.e., global ILD) may change significantly when energy in a spectrum alternates between speech-dominated and background-dominated over time.

Initially, a max module 406 of the cluster tracker 402 determines a maximum energy between channels at each frequency. In exemplary embodiments utilizing a primary and a secondary microphone 106 and 108, a primary and a secondary energy spectrum will be provided to the max module 406 by the energy module 304. The max module 406 determines which of the two energy spectrums has a higher energy estimate at each frequency. The higher energy estimate may be assumed to be a more accurate estimate of a total energy per frequency. As such, each frequency will have a local maximum energy estimate determined by the max module 406 resulting in a spectrum of local level maximum energy.

A spectrum of local ILDs calculated by the ILD module 306 is received by a weighting module 408 of the cluster tracker 402. The local maximum energy estimate for each frequency is applied to the local ILD for the same frequency by the weighting module 408. In exemplary embodiments, a global ILD (i.e., a global summary of an acoustic feature) may then be calculated based, at least in part, on summing the weighted local ILDs and dividing a result by a sum of the number of weights.

According to exemplary embodiments, the global ILD comprises a good indicator of a presence of a wanted signal (e.g., speech). For example, speech has a nature whereby high energy is concentrated in regions when speech is present. When speech is no longer present, then the global ILD may make a huge leap to a low value.

The global ILD may be a sum across frequencies of the product of the ILD at each frequency with the energy at that frequency, divided by the sum of the energies at all frequencies:

$$\frac{\sum_f ILD_f E_f}{\sum_f E_f}$$

Based on the newly calculated global ILD, a frame type may be determined by a frame classifier 410. In various embodiments, the frame classifier 410 classifies a frame type (i.e., an instantaneous global classification) based on the global ILD (i.e., global summary of acoustic features) in comparison with global clusters (i.e., global running estimates). These global clusters represent an average running mean and variance for ILD observations for a source (i.e., a global source cluster), a background (i.e., a global background cluster), and a distractor (i.e., a global distractor cluster). A first pass of the frame classifier 410 may utilize initialized values for these global clusters to initial guess values or predetermined values. Subsequent values for the global clusters may be updated over time with, for example, a leaky integrator, when the global ILD is significantly above or below their mean.

The exemplary frame classifier 410 may compare the calculated global ILD to the tracked global clusters and classify the frame based on a position of the global ILD with respect to the global clusters (i.e., which global cluster is closest to the global ILD). For example, if the global ILD is closest to the global source cluster, then the associated frame is classified as a source frame by the frame classifier 410. Similarly if the global ILD is closest to the global background cluster, then the frame is classified as a background frame. If the result is ambiguous, then the frame may be classified as unknown by the frame classifier 410.

According to exemplary embodiments, the frame types may comprise source, background, and distractor. The distractor may comprise an intermittent, very low ILD observation. For example, a secondary source providing audio to the secondary microphone 108 may create a distractor. If the frame is classified as a distractor, the global average may not be updated with the current global ILD. Alternative embodiments may utilize other frame types or combinations of frame types.

The distractor classification is generally utilized to remove outlier sources that may otherwise adversely affect the global (or local) background cluster. In a spread microphone embodiment, distant sources will typically have an ILD close to zero. A negative ILD is rare, but possible, for example, when wind is blowing against the secondary microphone 108 or when the user talks into a wrong side of the audio device 104. In some embodiments, extremely low signals may not be considered outliers as that may be where noise originates. In these embodiments, the distractor classification may be disabled or not utilized.

The distractor classification may also be disabled in embodiments utilizing array processing instead of spread-mic ILDs. In array processing embodiments, background noise ILDs may be significantly higher or lower than zero. In situations where the background noise ILD is significantly lower than zero, the background ILD may be classified as a distractor. Because this may result in system degradation, the distractor classification may be disabled (e.g., fixing the distractor value to a value well outside of a range of any observation).

Using the current calculated global ILD, a global selective updater 412 may update the global average running mean and variance (i.e., global clusters) for the (speech) source, background, and distractors. According to one embodiment, if the frame is classified as a source, background, or distractor, the corresponding global cluster is considered active and is moved towards the global ILD. The source, background, or distractor global clusters that do not match the frame classification are considered inactive. Source and distractor global clusters that remain inactive for more than a predetermined period of time may move toward the background global cluster. If the background global cluster remains inactive for more than a predetermined period of time, the background global cluster may be moved towards a global average.

The global average comprises a running average of all global observations (e.g., source, background, and/or distractor). As such, the global average may be continuously updated. For example, if the ILD alternates between a low value and a high value, and low values stop occurring, the global average will start to rise. In some embodiments, the global average may be used to update the global background cluster if the background cluster has been inactive for a long period of time.

According to some embodiments, if source and background energy estimates remain sufficiently far apart (e.g., an estimated SNR remains high) and a recent range of source energy estimates remains small, the global background cluster may be frozen. That is, the global background cluster may not move.

Once the frame types are determined, the cluster tracker 402 performs frame verification using local values. In exemplary embodiments, a local selective updater 414 receives the local ILDs (e.g., for each frequency) from the ILD module 306. Similar to the global ILD, each local ILD may be classified as (speech) source, background, or distractor by comparing the each local ILD to local clusters (e.g., local source cluster, local background cluster, and local distractor cluster). Thus, a local classification may be made (i.e., an instantaneous local classification). On a first pass, the local clusters may be initialized, for example, to the corresponding global cluster values or to predetermined values.

In cases where the global and the local classifications are similar in value this may provide confirmation that the frame classification is valid. For example, a local ILD observation may be classified as source if it is significantly above a mean of the local source and background clusters. Similarly, the global ILD is significantly above the mean of the global source and background clusters. As such, the frame is verified to be a source frame for these local observations.

The local selective updater 414 may also update the local average running mean and variance (i.e., local clusters or local running estimates) for the source, background, and distractor local clusters using, for example, a leaky integrator. The process of updating the local active and inactive clusters is similar to the process of updating the global active and inactive clusters. In exemplary embodiments, if the local classification matches the (global) frame classification (e.g., both classifications are either source, background, or distractor), then the local classification is considered reliable, and the corresponding local cluster is updated.

In situations where there is not a match (e.g., when speech dominates most of the spectrum resulting in the frame classification as source but noise dominates a small part of the spectrum where the speech energy is weak), the local clusters are not updated. That is, the source, background, or distractor local clusters that do not match the frame classification are considered inactive. Source and distractor local clusters that remain inactive for more than a predetermined period of time may move toward the background local cluster. If the background local cluster remains inactive for more than a predetermined period of time, the background local cluster may be moved towards a local average. This local average comprises a running average of all local observations. As such, the local average is continuously updated.

In some embodiments, exceptional circumstances may occur that affect the cluster tracker 402. For example, a given cluster may not update for an extended period of time. This may occur if a user moves away from the handset. In this situation, the associated ILDs may drop to a very low level such that the source cluster is not updated. Conversely, if the ILD of background noise suddenly rises, the observation may be classified as source and the background cluster may not be updated. In these embodiments where source-dominated or background-dominated frames do not alternate frequently enough, an assumption may be made that the cluster tracker 402 has lost track of a true location of an un-updated cluster. As a result, an auto-centering process may be performed by the local selective updater 414, whereby inactive clusters are moved toward long-term ILD means. This process may be referred to as a cluster timeout.

However, a rare case may occur where speech is continuous enough to cause an invalid cluster timeout of the global background cluster. This may result in the background cluster rising which may cause noise leakage or speech suppression. In this situation, a background cluster freeze may be applied. In this embodiment, the local selective updater 414 may monitor statistics of the source clusters and disable the cluster timeout behavior if the source cluster remains stable and sufficiently distant from the background cluster.

In yet another exceptional circumstance, source and background clusters may migrate towards each other. For example, if a user is silent, the ILDs may not fall into either the range of the source cluster or the background cluster. To prevent convergence of the source and background clusters, a predetermined limit may be imposed to prevent the source and background cluster from coming to close to each other.

The output of the cluster tracker 402 is forwarded to the spectral energy classifier 404. In various embodiments, based on these local clusters and observations, the spectral energy classifier 404 classifies points in the energy spectrum as being speech or noise. As such, a local binary mask for each point in the energy spectrum is identified as either speech or noise. The results of the spectral energy classifier 404 (e.g., energy and amplitude spectrums) are then forwarded to the noise estimate module 310. Essentially, a current estimate of noise along with locations in the energy spectrum where the noise may be located are provided to the noise estimate module 310.

In an alternative embodiment, an example of an adaptive classifier 308 may track a minimum ILD in each frequency band using a minimum statistics estimator. The classification thresholds may be placed at a fixed distance (e.g., 3 dB) above the minimum ILD in each band. Alternatively, the thresholds may be placed a variable distance above the minimum ILD in each band, depending on the recently observed range of ILD values observed in each band. For example, if the observed range of ILDs is beyond 6 dB (decibels), a threshold may be placed such that it is midway between the minimum and maximum ILDs observed in each band over a certain specified period of time (e.g., 2 seconds).

Although the global and local ILD is discussed in FIG. 4, those skilled in the art will appreciate that any one or more acoustic features may be used within various embodiments described. For example, the global ILD and local ILD may be any global acoustic feature and any local acoustic feature. In some embodiments, the global acoustic feature may include two or more acoustic features (e.g., an ILD and time shift). In other embodiments, multiple cluster trackers 402 may utilize different acoustic features within the same system.

Further, although FIG. 4 describes frames, frames are not necessary or required. Those skilled in the art will appreciate that any samples and/or data may be used in place of frames and still be within the scope of present embodiments.

Figure 5:
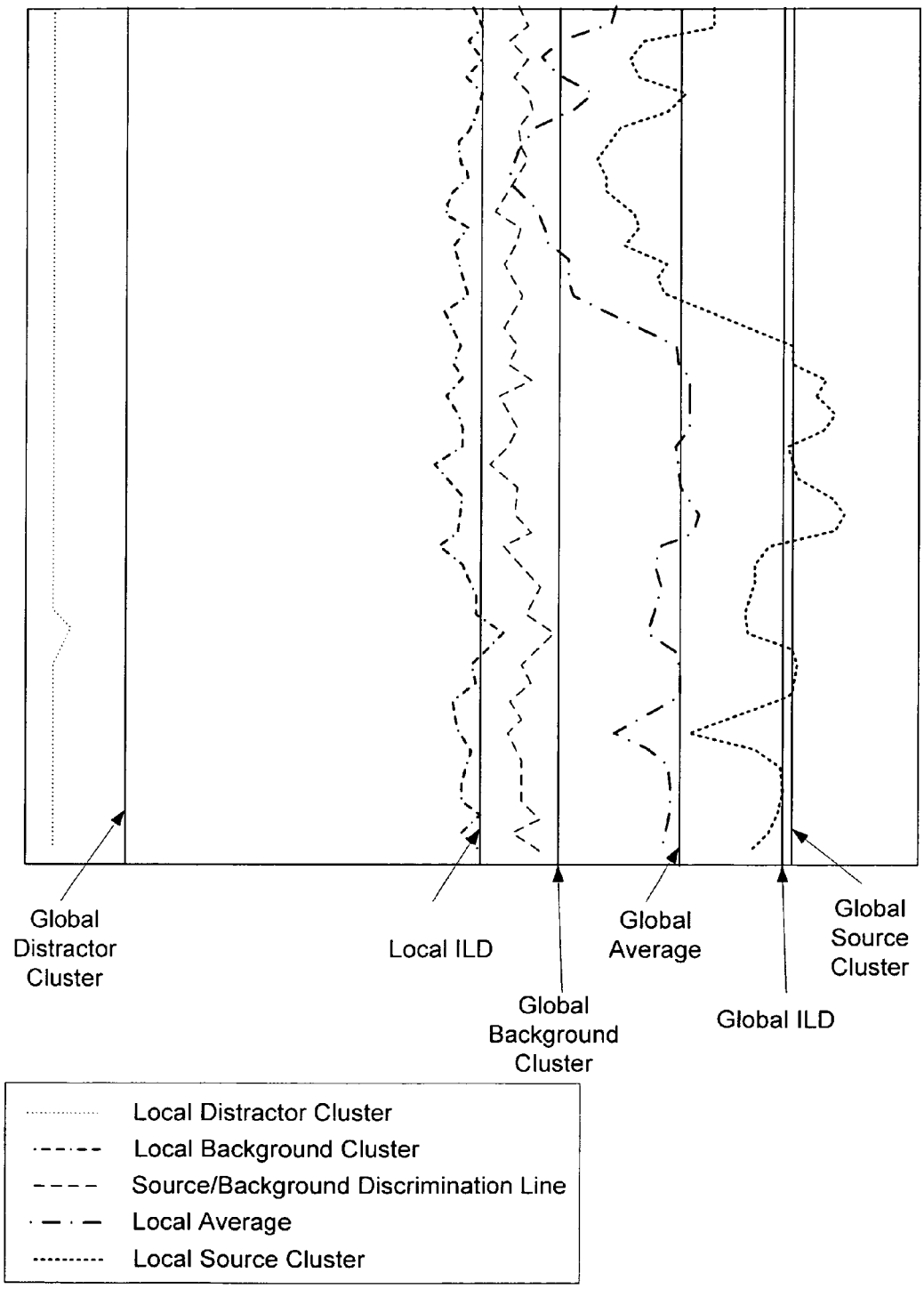
FIG. 5 is a diagram illustrating an exemplary screenshot of a cluster tracker display.

Referring now to FIG. 5, a diagram illustrating an exemplary screenshot of a cluster tracker display for an instantaneous observation is shown. The x-axis represents the ILD (e.g., low to high ILD), while the y-axis represents frequency (e.g., low to high frequency). Straight lines illustrated in the display represent global measurements, and wiggly lines are local (e.g., per frequency or tap) measurements.

A source/background discrimination line, derived based on local source and background clusters, is also provided. Any ILDs to the right of this discrimination line is considered source and any ILDs to the left of this discrimination line is considered noise (or distractor). The distractor may be located at a distance from the background and source clusters. As illustrated, the global ILD is positioned close to the global source cluster. Thus, the present observation will indicate a frame classification of (speech) source.

Figure 6:
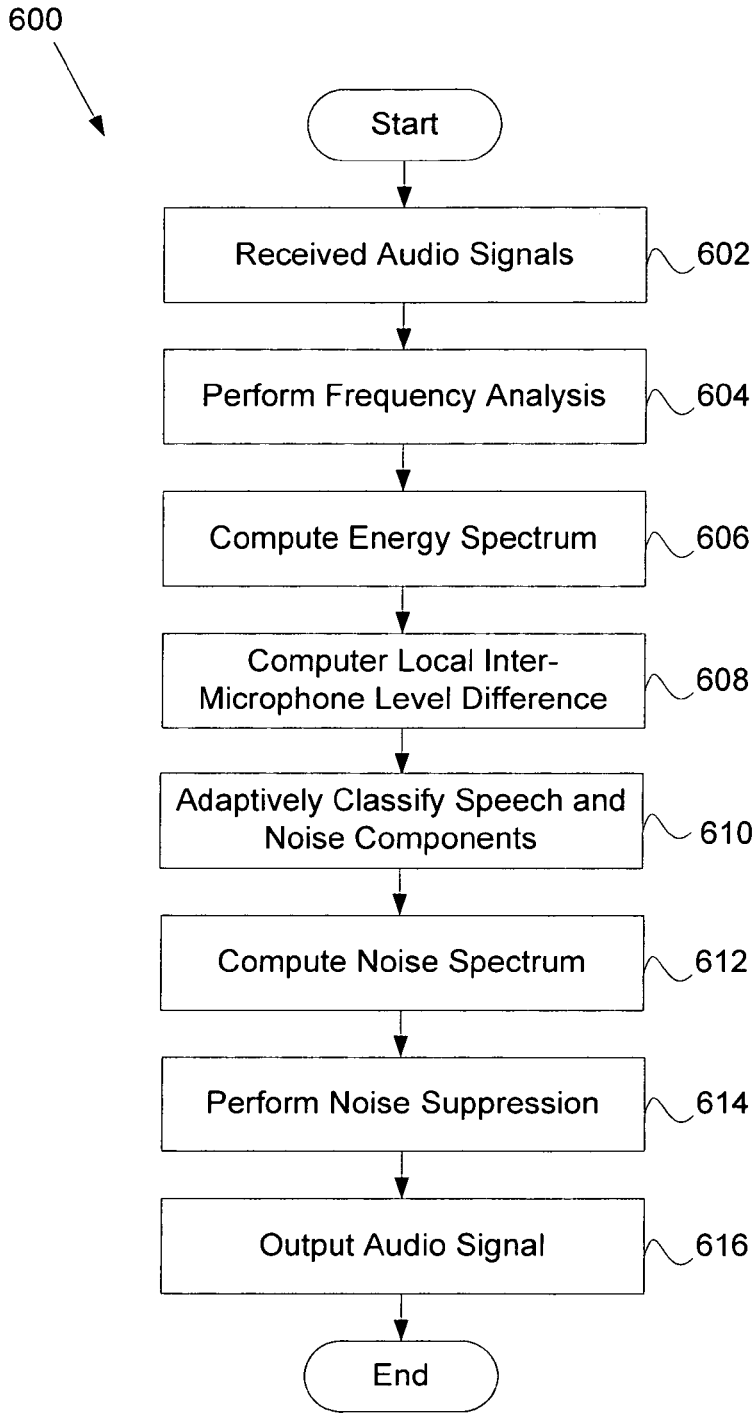
FIG. 6 is a flowchart of an exemplary method for adaptive intelligent noise suppression.

Referring now to FIG. 6, an exemplary flowchart 600 of an exemplary method for noise suppression utilizing an adaptive classifier 308 is shown. In step 602, audio signals are received by a primary microphone 106 and an optional secondary microphone 108. In exemplary embodiments, the acoustic signals are converted to a digital format for processing.

Frequency analysis is then performed on the acoustic signals by the frequency analysis module 302 in step 604. According to one embodiment, the frequency analysis module 302 utilizes a filter bank to determine individual frequency bands present in the acoustic signal(s).

In step 606, energy spectrums for acoustic signals received at both the primary and secondary microphones 106 and 108 are computed. In one embodiment, the energy estimate of each frequency band is determined by the energy module 304. In exemplary embodiments, the exemplary energy module 304 utilizes a present acoustic signal and a previously calculated energy estimate to determine the present energy estimate.

Once the energy estimates are calculated, inter-microphone level differences (ILDs) are computed in optional step 608. In one embodiment, the ILDs are calculated based on the energy estimates (i.e., the energy spectrum) of both the primary and secondary acoustic signals. In exemplary embodiments, the ILDs are computed by the ILD module 306.

Speech and noise components are adaptively classified in step 610. In exemplary embodiments, the adaptive classifier 308 analyzes the received energy estimates and, if available, the ILD to distinguish speech from noise in an acoustic signal. Step 610 will be discussed in more detail in connection with FIG. 7.

Subsequently, the noise spectrum is determined in step 612. According to embodiments of the present invention, the noise estimates for each frequency band is based on the acoustic signal received at the primary microphone 106. In some embodiments, the noise estimate may be based on the present energy estimate for the frequency band of the acoustic signal from the primary microphone 106 and a previously computed noise estimate. In determining the noise estimate, the noise estimation may be frozen or slowed down when the ILD increases, according to exemplary embodiments of the present invention.

In step 614, noise suppression is performed. Initially, gain masks may be calculated by the AIS generator 312. The calculated gain masks may be based on the primary power spectrum, the noise spectrum, and the ILD. According to one embodiment, a speech loss distortion (SLD) amount is estimated by first computing an internal estimate of long-term speech levels (SL), which may be based on the primary spectrum and the ILD. Once the SL estimate is determined, the SLD estimate may be calculated. Control signals may then be derived based on the SLD amount. Subsequently, a gain mask for a current frequency band may be generated based on a short-term signal and the noise estimate for the frequency band by an enhancement filter. If another frequency band of the acoustic signal requires the calculation of a gain mask, then the process is repeated until the entire frequency spectrum is accommodated.

Once the gain masks are calculated, the gain masks may be applied to the primary acoustic signal. In exemplary embodiments, the masking module 314 applies the gain masks. The masked frequency bands of the primary acoustic signal may then be converted back to the time domain. Exemplary conversion techniques apply an inverse frequency of the cochlea channel to the masked frequency bands in order to synthesize the masked frequency bands. In some embodiments, a comfort noise may be generated by the comfort noise generator 318. The comfort noise may be set at a level that is slightly above audibility. The comfort noise may then be applied to the synthesized acoustic signal.

The noise suppressed acoustic signal may then be output to the user in step 616. In some embodiments, the digital acoustic signal is converted to an analog signal for output. The output may be via a speaker, earpieces, or other similar devices, for example.

Figure 7:
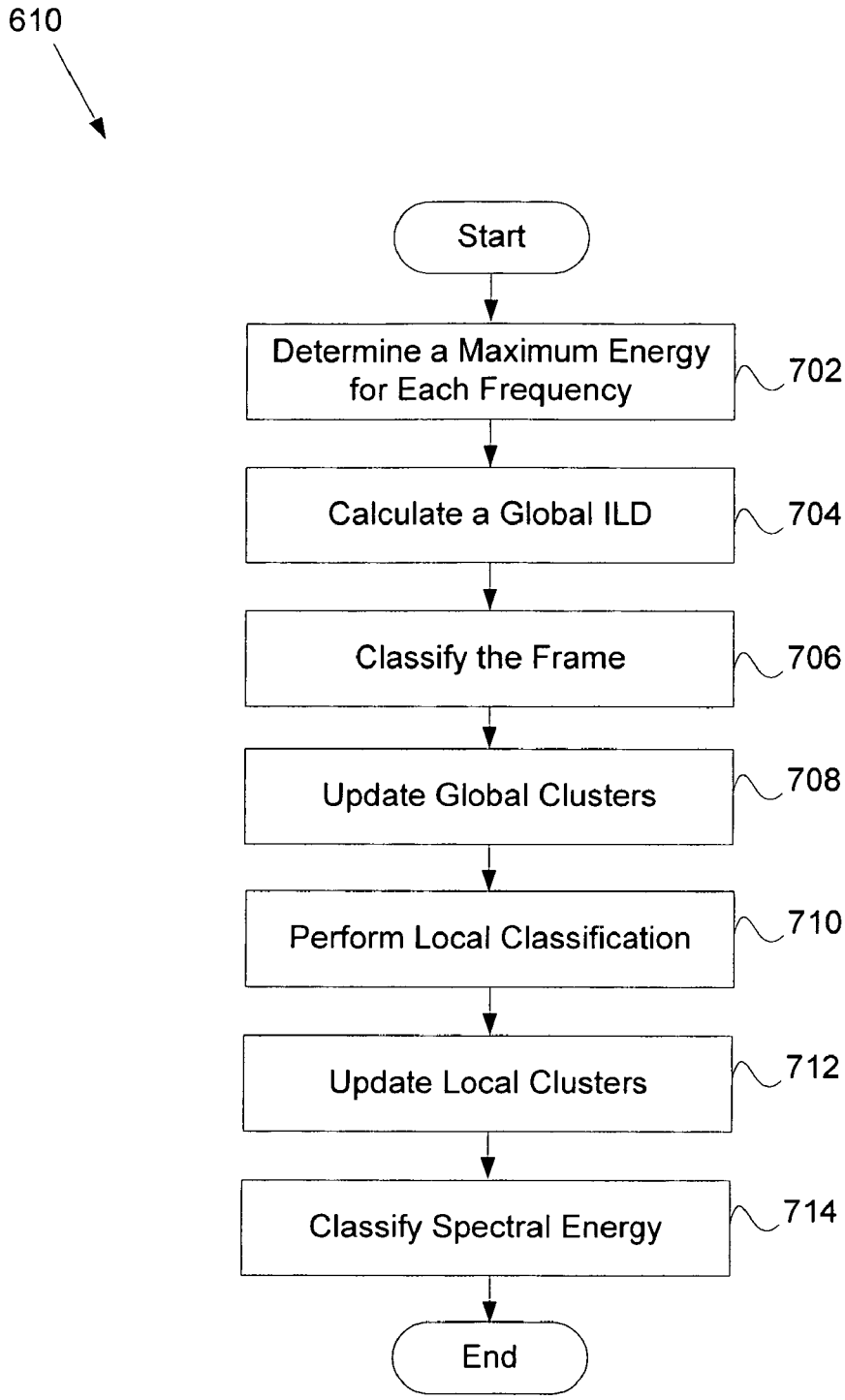
FIG. 7 is a flowchart of an exemplary method for adaptive classification of audio sources in an adaptive intelligent noise suppression embodiment.

Referring now to FIG. 7, a flowchart of an exemplary method for adaptively classifying speech and noise components is provided. In exemplary embodiments, the methods of FIG. 7 are performed by an adaptive classifier 308 comprising at least a cluster tracker 402.

In step 702, a maximum energy for each frequency is determined. According to one embodiment, the max module 406 will compare an energy spectrum of a primary and second acoustic signal. A higher of the two energies at each frequency is then determined, thereby creating a maximum energy spectrum.

In some embodiments, a contribution of how much the ILD at a given part of the spectrum contributes to the global ILD is determined. In one example, the ILD observation at a given frequency is weighted by an amount of energy at that frequency. In another example, the ILD observation could be weighted based on amplitude, or given different weights depending on the ILD or the distribution of background ILDs. Those skilled in the art will appreciate that there may be many ways to determine the contribution of how much the ILD at a given part of the spectrum contributes to the global ILD.

A global ILD may then be calculated in step 704 based on the maximum energy spectrum. In exemplary embodiments, the weighting module 408 receiving local ILDs (at each frequency) from the ILD module 306 and apply the corresponding maximum energy to the local ILD at each frequency. The total is then divided by a sum of the number of weights to determine the global ILD.

Based on the global ILD, the frame is classified in step 706. According to exemplary embodiments, the frame classifier 410 will compare the global ILD against tracked global clusters. These global clusters represent the average running mean and variance for ILD observations for a speech source, background, and distractors (if enabled). According to one embodiment, the tracked global cluster that is closest to the global ILD will identify the frame. For example, if the source global cluster is closest to the global ILD, then the frame is classified as a source frame.

In step 708, the global clusters are updated. In exemplary embodiments, the global selective updater 412 updates global average running mean and variance of active. If the global cluster is active, the global cluster may be moved towards the global ILD. In some embodiments, inactive global clusters may also be updated. For example, if the background global cluster remains inactive for more than a predetermined period of time the background global cluster may be moved towards a global average.

In step 710, local classification is performed. According to exemplary embodiments, the local selective updater 414 receives the local ILDs from the ILD module 306 and compares the local ILDs to local clusters (e.g., local source, background, and distractor clusters). The local cluster closest to the local ILD identifies the local observation as being a source (e.g., speech), background, or distractor. A local observation that matches the frame classification provides verification of the frame classification.

The local clusters may be updated in step 712. Thus, the local selective updater 414 may update the local average running means and variance for the source, background, and distractor. The process of updating the local active and inactive clusters is similar to that of the global clusters.

In step 714, spectral energy is classified according to the results of the cluster tracker 402. In exemplary embodiments, the spectral energy classifier 404 classifies points in the energy spectrum as being speech, noise, and in some embodiments, distractor. The results are forwarded to the noise estimation module 310.

The above-described modules can be comprises of instructions that are stored on storage media. The instructions can be retrieved and executed by the processor 202. Some examples of instructions include software, program code, and firmware. Some examples of storage media comprise memory devices and integrated circuits. The instructions are operational when executed by the processor 202 to direct the processor 202 to operate in accordance with embodiments of the present invention. Those skilled in the art are familiar with instructions, processor(s), and storage media.

The present invention is described above with reference to exemplary embodiments. It will be apparent to those skilled in the art that various modifications may be made and other embodiments can be used without departing from the broader scope of the present invention. For example, embodiments of the present invention may be applied to any system (e.g., non speech enhancement system) as long as a noise power spectrum estimate is available. Therefore, these and other variations upon the exemplary embodiments are intended to be covered by the present invention.

The invention claimed is:

1. A method for processing acoustic signals, comprising:

receiving at least one acoustic signal;

deriving one or more acoustic features based on the at least one acoustic signal;

determining a global summary of acoustic features based, at least in part, on the derived one or more acoustic features;

determining an instantaneous global classification based on a global running estimate and the global summary of acoustic features;

updating the global running estimates;

deriving an instantaneous local classification based on at least the one or more acoustic features;

determining one or more spectral energy classifications based, at least in part, on the instantaneous local classification and the one or more acoustic features; and providing the spectral energy classification.

2. The method of claim 1 wherein the one or more acoustic features are frequency specific.

3. The method of claim 1 wherein the one or more acoustic features comprises an inter-microphone level difference between a primary acoustic signal and a secondary acoustic signal of the at least one acoustic signal.

4. The method of claim 1 wherein the one or more acoustic features comprises a time difference within the at least one acoustic signal.

5. The method of claim 1 further comprising calculating a noise power spectrum based on the spectral energy classification.

6. The method of claim 5 further comprising generating an adaptive gain mask based on the noise power spectrum.

7. The method of claim 6 further comprising applying the adaptive gain mask to the primary acoustic signal.

8. The method of claim 1 further comprising generating and applying a comfort noise to a noise suppressed signal prior to output.

9. The method of claim 1 wherein determining the global summary of acoustic features comprises summing weighted local inter-microphone level differences.

10. The method of claim 1 wherein determining an instantaneous global classification comprises comparing the global summary of acoustic features to the global running estimates and classifying with respect to which global running estimate is closest to the global summary of acoustic features.

11. A non-transitory computer-readable storage medium having embodied thereon a program, the program providing instructions executable by a processor for processing acoustic signals, the method comprising:

receiving at least one acoustic signal;

deriving one or more acoustic features based on the at least one acoustic signal;

determining a global summary of acoustic features based, at least in part, on the derived one or more acoustic features;

determining an instantaneous global classification based on a global running estimate and the global summary of acoustic features;

updating the global running estimates;

deriving an instantaneous local classification based on at least the one or more acoustic features;

determining one or more spectral energy classifications based, at least in part, on the instantaneous local classification and the one or more acoustic features; and providing the spectral energy classification.

12. The non-transitory computer-readable storage medium of claim 11 wherein the one or more acoustic features are frequency specific.

13. The non-transitory computer-readable storage medium of claim 11 wherein determining the global summary of acoustic features comprises summing weighted local inter-microphone level differences.

14. The non-transitory computer-readable storage medium of claim 11 wherein determining an instantaneous global classification comprises comparing the global summary of acoustic features to the global running estimates and classifying with respect to which global running estimate is closest to the global summary of acoustic features.

* * * * *